United States Patent [19]

Ehemann et al.

[11] 4,289,159

[45] Sep. 15, 1981

[54] OUTLET VALVE FOR A GAS COMPRESSOR

[75] Inventors: Horst Ehemann, Neuenstadt; Max Ruf, Neckarsulm, both of Fed. Rep. of Germany

[73] Assignee: Audi NSU Auto Union, Neckarsulm, Fed. Rep. of Germany

[21] Appl. No.: 81,828

[22] Filed: Oct. 4, 1979

[30] Foreign Application Priority Data

Nov. 11, 1978 [DE] Fed. Rep. of Germany ..... 2849075

[51] Int. Cl.[3] ..... F16K 15/16

[52] U.S. Cl. ..... 137/454.4; 137/454.5; 137/512.15

[58] Field of Search ..... 137/454.2, 454.6, 512.15, 137/454.4, 454.5

[56] References Cited

U.S. PATENT DOCUMENTS

| | | | |
|---|---|---|---|
| 1,376,484 | 5/1921 | Tuttle | 137/512.15 |
| 2,595,986 | 5/1952 | Schwaller | 137/512.15 |
| 3,463,184 | 8/1969 | Köhler et al. | 137/512.15 |
| 3,786,833 | 1/1974 | Frenkel | 137/512.15 |

FOREIGN PATENT DOCUMENTS

| | | | |
|---|---|---|---|
| 1500097 | 4/1969 | Fed. Rep. of Germany | 137/512.15 |
| 1500068 | 5/1969 | Fed. Rep. of Germany | 137/512.15 |
| 1215900 | 12/1970 | United Kingdom | 137/512.15 |
| 1238524 | 7/1971 | United Kingdom | 137/512.15 |

*Primary Examiner*—William R. Cline
*Assistant Examiner*—H. Jay Spiegel
*Attorney, Agent, or Firm*—Kane, Dalsimer, Kane, Sullivan and Kurucz

[57] ABSTRACT

An outlet valve for a gas compressor includes a valve seat 1 formed with several rows of apertures 16, a thin flat valve plate 2 having several spaced spring tongues overlapping the apertures, a limit plate 4 overlying the valve plate, and a pressure member 5 above the limit plate. To control and damp the movement and flutter of the valve plate it is frictionally gripped between the limit plate 4 and the valve seat, and springs 15 press the limit plate against the valve plate. Both the valve plate and limit plate can move towards and away from the pressure member 5, this movement being restricted to a fraction of a millimeter by spacer bushes 14 and spacer studs 7. The underside of the limit plate 4 is concavely curved to correspond to the natural bending curvature of the thin valve plate.

2 Claims, 4 Drawing Figures

FIG. 2
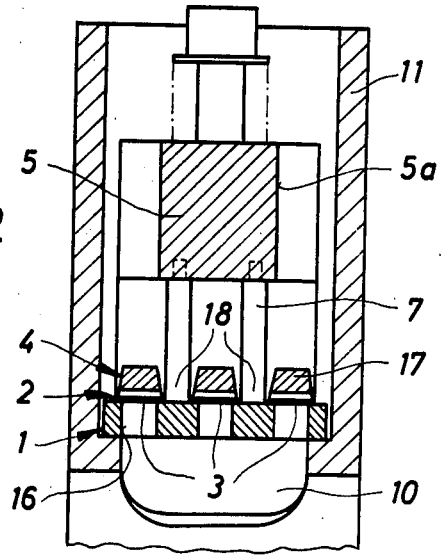
FIG. 3
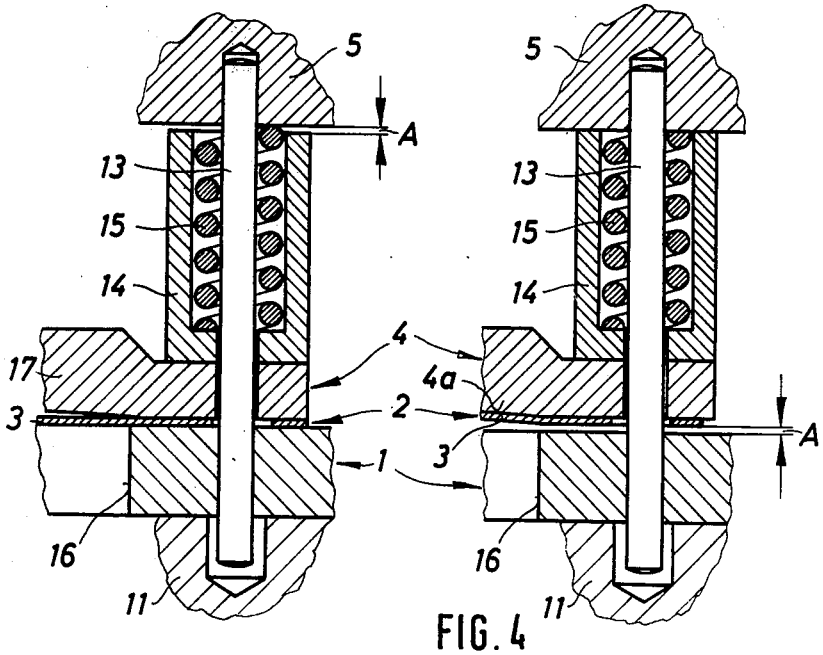
FIG. 4

OUTLET VALVE FOR A GAS COMPRESSOR

BACKGROUND OF THE INVENTION

This invention relates to an outlet or non-return valve for a compressor, of the type comprising a valve seat having gas flow apertures or passages, a valve plate with valve closing spring tongues to cover and close the apertures, and a limit member which limits the lift of the valve plate.

In such outlet valves large through flow cross-sections can be obtained and the mass of the moving closing tongues can be kept relatively small, but with high delivery capacity the closing tongues cannot be prevented from a tendency to flutter and therefore to produce considerable noise, but more especially, from being subject to heavy stress on account of their high impact velocity.

SUMMARY OF THE INVENTION

An object of the invention accordingly is to produce an outlet valve of the type referred to, in which fluttering and high stresses are reduced even at high delivery rates.

The invention provides an outlet valve for a compressor, comprising a valve seat having through apertures, a valve plate with spring closing tongues to cover the through apertures, a limit member which limits the lift of the valve plate and is curved concavely on the side which the valve plate engages, a pressure member arranged to fix the complete valve in the housing of the compressor, guide means to allow the limit member to lift relative to the valve seat, the valve plate being movably mounted at at least one end between the valve seat and the limit member, springs pressing the limit member against the closing tongues of the valve plate, and spacers arranged between the pressure member and the limit member to limit the lift of the limit member, the valve seat with the valve plate, limit member and pressure member being assembled in one unit.

In a particular preferred construction the free ends of the closing tongues, in contrast to known prior constructions, are mounted in a movable gap between the valve seat and the limit plate, and fluttering of the tongues can thus be limited or avoided during actuation by air or gas, and the heavy stresses can be considerably reduced. The curvature of the limit plate limits the lift of the closing tongues to a small travel but permits the largest possible flow cross-section when they are fully in engagement. When the valve closing tongues are lifted against the limit plate, a gap is simultaneously formed between the limit plate and the valve plate as a result of the provision of spacing bushes, and this gap allows for movement of the ends of the valve tongues in a longitudinal direction, which occurs as a result of the rising of the valve plate to engage with the limit plate. On the other hand, since the spring presses the limit plate with the closing tongues against the valve plate, the movement of the closing tongues when returning is damped by the friction between the valve plate and the limit plate.

To reduce the stresses in the valve closing tongues and increase their service life, the curvature of the limit plate may have an equally large or slightly larger radius than that which the closing tongues adopt under their maximum permitted degree of bending stress.

To provide a mounting which makes possible a cushioned or damped movement of the closing tongues so as to reduce or prevent fluttering, it is preferable that the lift of the limit plate should be reduced by means of the spacers to a fraction of a millimeter.

The guide means for the limit plate can consist of studs or pins which pass through the limit plate and the valve plate close to their ends, and are fixed to the valve seat and the pressure plate. A spacer bush and a spring may be arranged on each such stud in order to guide the limit plate, and provide a space-saving construction.

Further details and features of the invention are disclosed in the following description and accompanying drawings, which illustrate one example of the invention.

BRIEF DESCRIPTION OF THE DRAWINGS

In the drawings:

FIG. 2 is a cross-section on the line II—II in FIG. 1, FIG. 3 is a view on an enlarged scale of the area ringed by a circle in FIG. 1, showing the parts in a first operative position, and FIG. 4 is a view similar to FIG. 3, showing the parts in a second operative position.

DETAILED DESCRIPTION OF THE INVENTION

Figure 1:
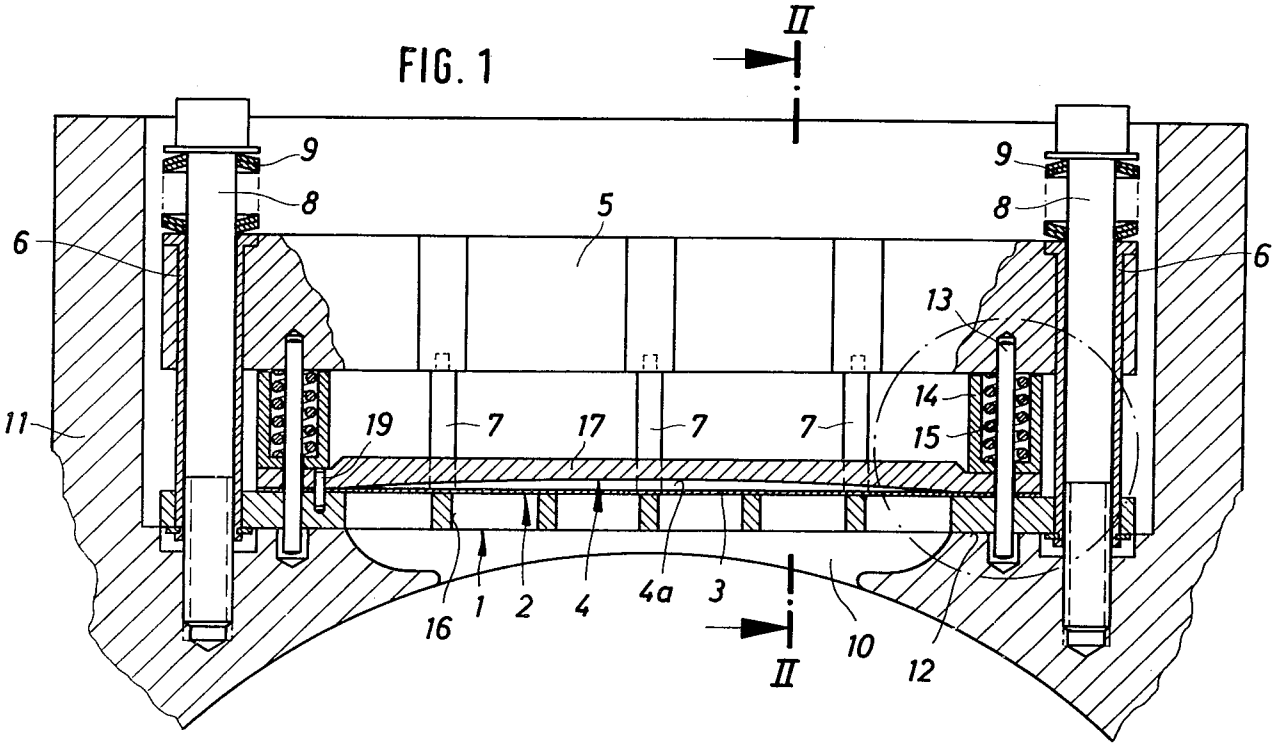
FIG. 1 is a cross-section through an outlet valve according to the invention.

The outlet valve for a rotary compressor as illustrated in FIG. 1, essentially consists of a valve seat 1, a flat thin valve plate 2 having spring closing tongues 3, and a limit plate 4, which limits the lift of the valve plate 2. The two ends of the valve plate 2 are movably mounted with the closing tongues 3 located between the ends of the limit plate 4 and the valve seat 1. The outlet valve is assembled together with a pressure plate 5 into one assembled unit in which the pressure plate 5 is connected to the valve seat 1 at each of its two ends by a sleeve 6, and is retained at a fixed spacing from the valve seat 1 by studs 7 located between the pressure plate 5 and the valve seat 1. The assembled unit is fixed in an outlet duct 10 of the housing 11 of a compressor by bolts 8, with dished spring washers 9 positioned between the bolt heads and the pressure plate 5, to press the valve seat hard against a support surface 12 in the outlet duct 10. The limit plate 4 is movably guided at its ends by cylindrical studs 13, so that some lifting movement of the limit plate 4 relative to the valve plate 2 and the valve seat 1 is possible. The studs 13, which are inserted in corresponding bores in the pressure plate 5 and the valve seat 1, are surrounded by spacing bushes 14, which are located between the limit plate 4 and the pressure plate 5 and are undersized or short in relation to the studs 7 by approximately 0.05 mm and hence limit the lift of the limit plate 4 to this figure as illustrated in FIGS. 3 and 4 by the gap A which is consequently formed. In addition compression springs 15 are located inside the spacing bushes 14 between the limit plate 4 and the pressure plate 5 so as to press the limit plate 4 against the valve plate 2 and the valve seat 1, the force of the springs 15 being designed and adjusted to such a value that the ends of the closing tongues 3 which are located between the limit plate 4 and the valve seat 1 are not locked but remain movable. The side of the limit plate 4 which faces the valve plate 2 is formed with a curved surface **4*a* against which the valve plate 2 with its closing tongues 3 is pressed when actuated by air or gas pressure and brought fully into engagement. The surface 4*a* has a curvature corresponding to the natural curvature of the valve plate 2 when it bends, according to its elasticity or permitted bending stress, so that the valve plate 2 is not subject to any detrimental bending stress. If the valve plate 2** is formed, for example, of spring steel, as is normal, the radius of curvature should not be less than 120 mm.

FIG. 2 illustrates the contruction of the valve seat 1 with through passages for the compressed gaseous medium in the form of slits 16 which are arranged in three rows, and are covered by the spring closing tongues 3 of the thin valve plate 2. Moreover it will be seen that the limit plate 4, at least in the area of the through slits 16, comprises three bridges or stays 17 between which are provided slots or gaps 18 to allow free unimpeded passage of the gas. The pressure plate 5 also has recesses 5*a*, designed to avoid restricting the gas flow.

In the cross-section of the outlet valve shown in FIG. 3, the limit plate 4 is shown in its position when there is no gas or air flow. In this position, the ends of the closing tongues 3 are pressed against the valve seat 1 by the limit plate 4 which is guided by the studs 13, and itself acted upon by the compression springs 15 located in the spacing bushes 14 and abutting against the pressure plate 5. The central part of the valve plate 2 between the ends of the closing tongues 3 is located by its inherent spring resilience against the valve seat 1 and closes the through passages 16. The gap of 0.05 mm which is formed between the spacing bushes 14 and the adjacent pressure plate 5 is indicated at A.

The positions indicated in FIG. 4 result when gas or air flows through the outlet valve. In this case the valve plate 2 with its closing tongues 3 is lifted off the valve seat 1, pressed against the limit plate 4 and made to engage with the curved surface 4*a*. Simultaneously, the limit plate 4, together with the contacting closing tongues 3, is raised slightly from the valve seat 1, this lift being limited by the spacing bushes 14, which in this position come into contact with the pressure plate 5. As a result of this lifting of the limit plate 4, the gap A is transferred to a position between the valve seat 1 and the valve plate 2, and therefore the two ends of the closing tongues 3 which are located between the limit plate 4 and the valve seat 1 can shift laterally to accommodate the variations in length occurring as a result of the engagement of the valve plate with the curved surface 4*a*.

This two-sided location of the valve plate 2 and its closing tongues 3 has the advantage that the closing tongues 3 only rise through a comparatively short distance which reduces stress, and moreover any tendency for fluttering is also prevented or reduced as a result of its location between the limit plate 4 and the valve seat 1. As soon as the opening of the outlet valve by air or gas is interrupted, the position shown in FIG. 3 is again restored, with the closing tongues 3 covering the through slits 16 and the ends of the tongues gripped again between the limit plate 4 and the valve seat 1, such that the movement between these guides is partly damped by friction.

It will be understood that the valve closing tongues 3 can be movably mounted at their two ends as in the example shown in FIGS. 3 and 4. However, it is also possible within the scope of the invention for the valve plate 2 to be movably mounted only on one side and to be firmly pinned on the other side by a pin 19—as indicated in FIG. 1. While the drawings show the outlet valve in the casing of a rotary piston compressor of the type disclosed in U.S. Pat. No. 4,105,375 it will be understood that this valve can be used also with reciprocating piston compressors.

We claim:

1. A compressor having a housing and an outlet valve which comprises: a valve seat having through apertures for working fluid; a resilient valve plate with spring closing tongues to cover said through apertures; a limit member which limits the lift of the valve plate and is curved concavely on a side thereof which faces the valve plate and which has apertures offset with respect to said through apertures; first spring means for resiliently urging the valve seat against an abutment face on the housing; a pressure member arranged between the first spring means and the limit member; first spacer means between the pressure member and the valve seat to fix the distance therebetween; second spring means between the pressure member and the limit member to urge the ends of the valve plate against the valve seat, at least one of said ends being movably mounted between the valve seat and the limit member; and second spacer means between the pressure member and the limit member to limit the lift of the latter relative to the valve seat to a fraction of a millimeter.

2. A compressor according to claim 1 wherein the second spring means are arranged upon guide pins for the limit member, and the second spacer means are formed by bushings which accommodate the second spring means.

* * * * *